United States Patent [19]

Ruedy et al.

[11] 4,097,761

[45] Jun. 27, 1978

[54] IMAGE TUBE CATHODE

[75] Inventors: John E. Ruedy; George A. Morton, both of Princeton, N.J.

[73] Assignee: RCA Corporation, New York, N.Y.

[21] Appl. No.: 531,644

[22] Filed: Feb. 16, 1966

[51] Int. Cl.[2] ..... H01J 39/00

[52] U.S. Cl. ..... 313/94

[58] Field of Search ..... 313/65, 66, 67, 94, 313/95, 329

[56] References Cited

U.S. PATENT DOCUMENTS

| | | | |
|---|---|---|---|
| 2,883,543 | 4/1959 | Wohl | 313/95 X |
| 3,121,648 | 2/1964 | Jensen | 313/94 X |

*Primary Examiner*—Maynard R. Wilbur
*Assistant Examiner*—T. M. Blum
*Attorney, Agent, or Firm*—G. H. Bruestle; R. M. Rodrick

[57] ABSTRACT

Photocathode having a transparent conductive undercoating to provide a radial voltage distribution across the cathode surface. The conductive undercoating is in the form of radially spaced rings made of chromium deposited on a glass substrate. Over the substrate and the conducting undercoating is provided a resistive layer comprising chromium having a thickness of about 50 Angstroms. Over the resistive chromium layer is deposited a photoemissive layer of antimony, potassium, sodium and cesium. The radially spaced conductive rings are connected to sources of different voltage to produce a desired voltage distribution across the resistive chromium layer.

10 Claims, 6 Drawing Figures

Fig. 4.
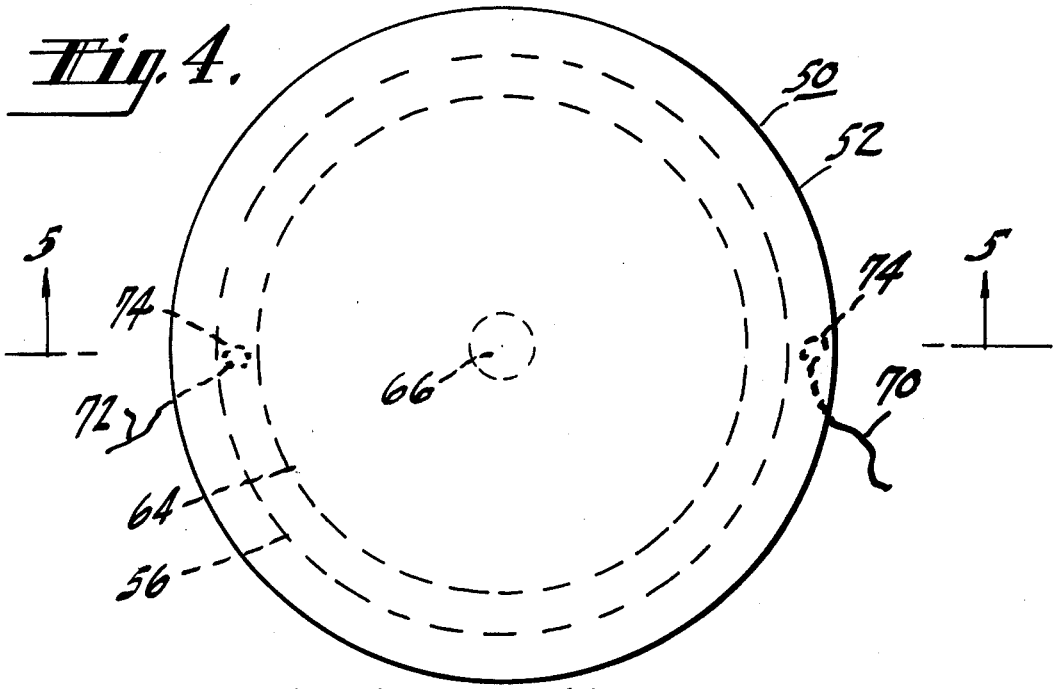
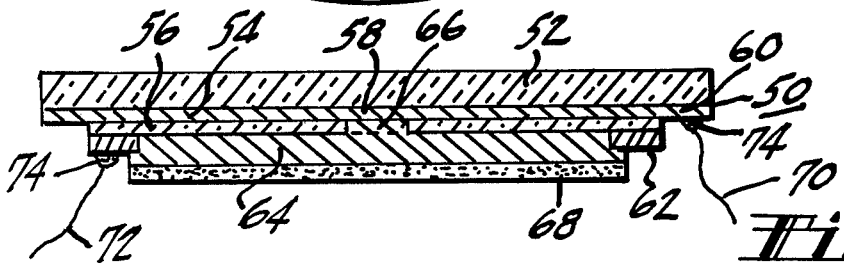
Fig. 5.
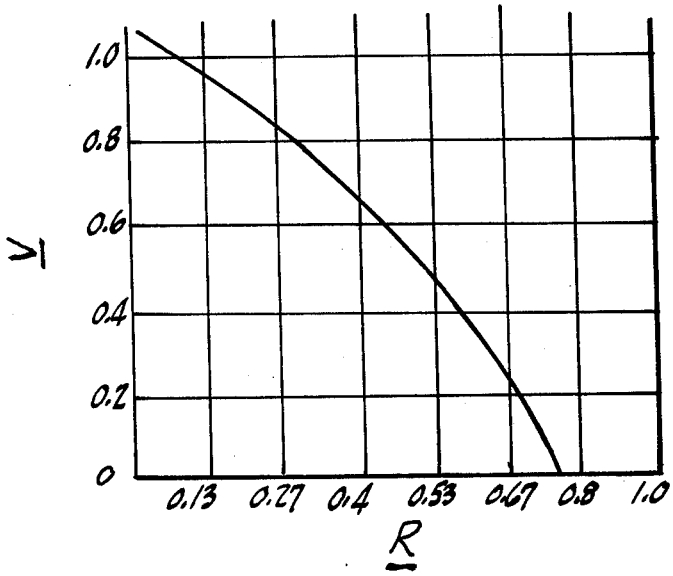
Fig. 6.

IMAGE TUBE CATHODE

This invention relates to photocathodes used in electron imaging systems, and particularly to electrostatically focused imaging systems. Cathodes of the type herein described have utility, among other places, in image tubes, image intensifier tubes, and television camera tubes.

Such tubes may comprise a photocathode on which a radiation image is optically focused. The photocathode emits photoelectrons from its surface in accordance with the intensity pattern of the radiation image. The emitted electrons are focused by suitable electrostatic focusing means onto a further electrode, where, for example, they are stored in order to produce an electrical charge image, excite a fluorescent screen to luminescence, or the like.

In the past, nearly all electrostatic focusing imaging systems used photocathodes having curved surfaces in order to correct certain image distortions caused by the focusing means. It was found, however, that the degree of curvature of the photocathode for ideal correction is so great that it interferes with the formation of a good optical image upon the photocathode by practical optical focusing means. The curvature used in the past, therefore, was generally a compromise between a photocathode surface which would best satisfy the requirements of the optical focusing means and a photocathode surface which would best satisfy the requirements of the electrostatic focusing means. The results of the compromise were less than perfect.

An object of this invention is to provide a novel and improved photocathode which more nearly satisfies both the electrostatic and optical focusing requirements of electrostatic imaging systems than prior known photocathodes.

Another object of this invention is to provide a novel and improved photocathode having a flat or planar surface, said photocathode including means for correcting image distortion caused by known electrostatic focusing systems, and having high sensitivity.

For achieving these objects, correction of the image distortion obtained in the past by the use of curved photocathodes is obtained by providing a photocathode having a voltage gradient or a voltage distribution along the surface of the cathode. To this end, a photocathode is provided including a substrate, a photoemissive surface, and a resistive layer underlying the photoemissive surface. Preferably, for reasons to be described, the resistive layer is transparent. Means are provided for applying a voltage differential between spaced portions of the resistive layer, whereby a voltage distribution can be produced along the surface of the cathode. Dependent upon the particular imaging system in which the photocathode is to be used, and the contour of the photocathode surface, different voltage distributions are provided.

In the drawings:

FIG. 4 is a plan view of another embodiment of a photocathode;

FIG. 5 is a sectional view along line 5—5 of FIG. 4; and

FIG. 6 is a graph showing an example of a radial voltage distribution used in the photocathode shown in FIGS. 4 and 5 when the photocathode is used in an image tube of the type shown in FIG. 3.

Figure 1:
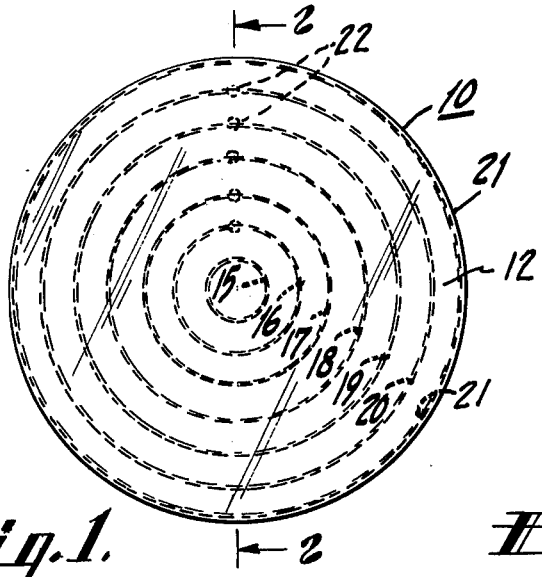
FIG. 1 is a plan view of a photocathode.
Figure 2:
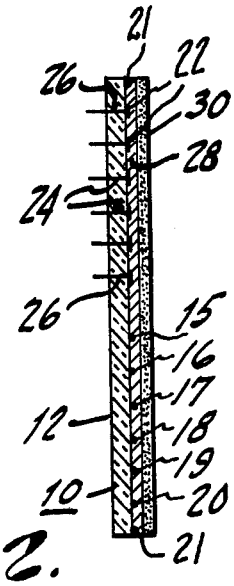
FIG. 2 is a section along line 2—2 of FIG. 1.

With reference to FIGS. 1 and 2, a photocathode 10 comprises a transparent circular substrate 12, such as glass. In this embodiment, as in the usual instance, the substrate 12 is flat to best match the optical requirements of the usual type of optical focusing systems. The present invention, however, also has utility in applications wherein a photocathode having a curved surface is desired. In devices using a Schmidt optical system, for example, a photocathode having a curvature opposite to that required for electrostatic imaging correction is desired. The present invention permits the use of such a reverse curved photocathode.

Mounted on the substrate 12 are a plurality of spaced-apart concentric rings 15, 16, 17, 18, 19, 20, and 21 of an electrically conductive material, such as chromium. Each ring 15–20 (but not the border ring 21) is electrically connected, as by means of silver paste dots 22, to fine wires 24 passing through bores 26 through the substrate 12. Means for making electrical connection to the ring 21 are described hereinafter. The bores 26 may be provided, for example, by supersonic drilling. The rings 15–21 may be provided, for example, by evaporating chromium through a suitable mask, and are of sufficient cross-section to serve as low resistance conductors. In one embodiment, the rings 15–21 are 30 mils wide and approximately 1000 Å thick.

Overlying the substrate 12 and the rings 15–21 is a layer 28 of an electrically resistive material, such as a thin metal film of chromium, a highly doped semiconductor material such as tin oxide, titanium oxide, or the like. Preferably, the layer 28 has high transparency. In one embodiment, an approximately 50 Å thick chromium layer 28 is used having a transparency of approximately 70%.

A chromium layer 28 may be provided, for example, by evaporating chromium from a nichrome filament and partially oxidizing the chromium by exposing the layer 28 to air while baking it at low temperature. A tin oxide layer 28 may be provided, for example, by spraying tin chloride onto a substrate 12 heated to a temperature of around 500° C., the tin chloride then decomposing to tin oxide. A titanium oxide film 28 may be provided, for example, by vacuum evaporation and subsequent baking in air. Each of these processes is known in the art.

Overlying the resistive layer 28 is a photoemissive layer 30 of a type used in known photocathodes, such as type S-20 comprising antimony, potassium, sodium, and cesium. The layer 28 may be provided in known manner.

Figure 3:
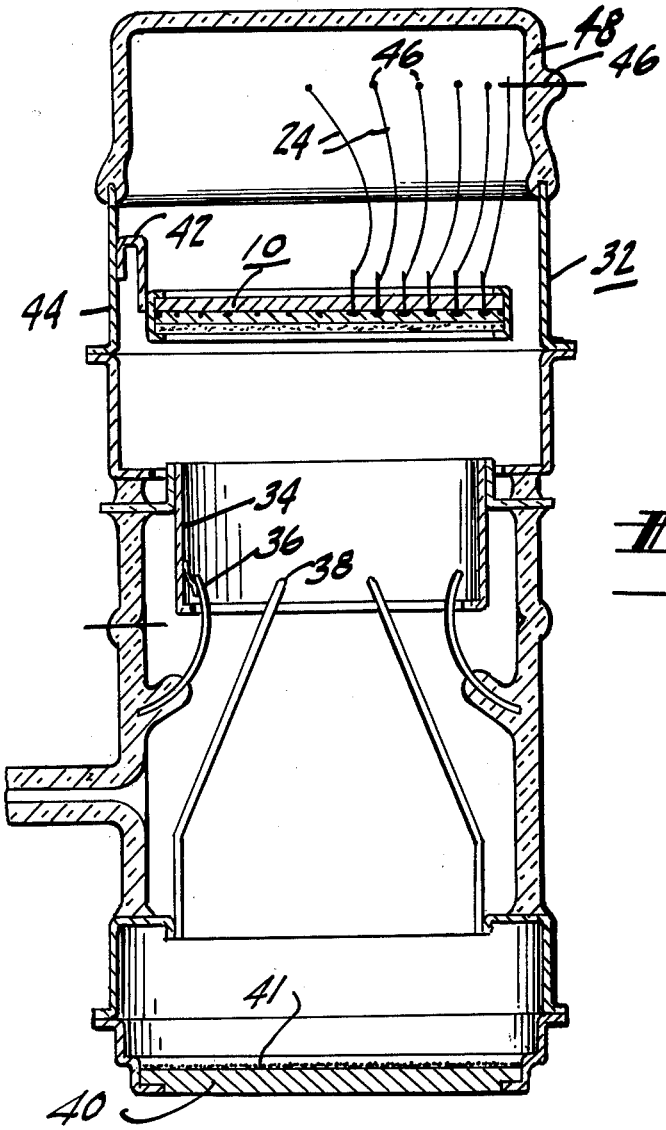
FIG. 3 is a section of an image tube utilizing the photocathode shown in FIGS. 1 and 2.

In the use of the photocathode 10, the cathode can be mounted in a known manner in an electron imaging device such as an image tube, a television camera tube, or the like. With reference to FIG. 3, the photocathode 10 is shown mounted in an electrostatically focused image tube 32 having a focusing system including electrically connected electrodes 34 and 36, electrode 38, and a glass end wall 40 having a layer of phosphor 41 on the inside surface thereof. The photocathode 10 is mounted on a conductive bracket 42 secured to a conductive side wall 44 of the tube 32. The bracket 42 is electrically connected to the border ring 21 of the cathode 10. Each wire 24 is connected to a different terminal 46 passing through a non-conductive side wall 48 of the tube. Details of the fabrication of the tube 32 are not given since such tubes and the fabrication thereof are known in the art.

Different direct current voltages are connected to the different terminals 46 and to the side wall 44, whereby a voltage gradient is produced in the resistive film 28 between each of the rings 15–21. The voltage gradient between each pair of concentric rings is radially symmetrical. The particular voltage distribution along the surface of the cathode is determined by the different voltages applied to the different rings 15–21. The selection of the voltage distribution is dependent upon the particular configuration of the imaging device in which the photocathode 10 is used.

For example, in the image tube 32 shown in FIG. 3, the photocathode 10 used has a diameter of 3 inches, and has seven concentric rings 15–21 spaced about 220 mils apart. The arrangement of the focusing electrode system, and the location of the photocathode 10 and the end wall 40 with respect thereto, are essentially the same as that in a commercial image tube, RCA 6914.

Excellent image distortion correction was obtained in one test with the following direct current voltages applied to the rings and electrodes:

| Rings | Voltage | Electrodes | Voltage |
|---|---|---|---|
| 15 | +360 | 34 | 1550 |
| 16 | 335 | 36 | 1550 |
| 17 | 285 | 38 | 15,000 |
| 18 | 220 | | |
| 19 | 135 | | |
| 20 | 57 | | |
| 21 | 0 | | |

With reference now to FIGS. 4 and 5, a photocathode 50 is shown comprising a transparent circular substrate 52, such as glass. Overlying the substrate 52 is a transparent film or layer 54 of a conductive material such as tin oxide. The tin oxide may be provided, for example, by spraying tin chloride onto a heated substrate, as described above. The layer 54 is made sufficiently thick to serve as a low resistance conductor.

Overlying portions of the conductive layer 54 is a layer 56 of a transparent insulating material such as glass, silica, magnesium oxide, or the like. The insulating layer 56 does not completely cover the conductive layer 54 but leaves uncovered a circular portion 58 at the center of the conductive layer 54, and an outer annular portion 60. The insulating layer 56 may be provided by known means such as RF sputtering, evaporation, chemical vapor deposition, or the like. For example, a silica layer may be provided by RF sputtering of silica in a noble gas such as argon.

Disposed on the insulating layer 56 adjacent to its outer edge is a ring 62 of a conductive material such as chromium. The ring 62 may be formed by known means, such as by evaporation through a mask, not shown, and is relatively thick to serve as a low resistance terminal.

Overlying the insulating layer 56, and extending through the circular opening through the insulating layer into contact with the circular portion 58 of the conducting layer 54, is a layer 64 of a transparent electrically resistive material such as chromium, tin oxide, titanium oxide, or the like. These materials may be provided as described above in connection with the fabrication of the photocathode 10. The resistive layer 64 is electrically connected to the ring 62 at the outer edge of the layer 64, and to the conductive layer 54 at the center 66 of the layer 64.

Overlying the resistive layer 64 is a layer 68 of a known photoemissive material such as the material used in type S-20 photocathodes.

Fine wires 70 and 72 are electrically connected to the annular portion 60 of the layer 54 and to the ring 62, respectively. The wires may be connected by known means, such as, for example, dots 74 of silver paste.

In the use of the photocathode 50, the cathode can be mounted in a known manner in an electrostatic imaging device, such as the one shown in FIG. 3. The wires 70 and 72 are connected to terminals of the device. Upon applying a direct current voltage between the device terminals, a radially symmetrical voltage gradient is produced in the resistive layer 64 from the center 66 thereof to its outer edge. The particular voltage distribution through the resistive layer 64 is dependent upon the resistivity characteristic or profile of the layer 64, and may be expressed as follows:

$$\frac{dV(r)}{dr} = \frac{i_o}{2\pi} \frac{p(r)}{r}$$

where:

$V(r)$ is the radial potential distribution, $r$ is the radial distance measured from the center of the cathode, $i_o$ is the total current through the cathode such that $i_oR = V$ with R being the total resistance of the cathode and $V_T$ the total voltage required for the image correction, and $p(r)$ is the surface resistivity (ohms per square).

A preferred means of obtaining a desired voltage distribution through the resistive layer 64 is to provide a layer 64 having varying lateral resistivity along the surface of the layer. This is preferably obtained by using a layer 64 having varying thickness. A variable-thickness layer 64 may be provided, for example, by using a rotating mask between the resistive material source and the cathode during the resistive layer deposition step. The mask is designed to provide varying exposure of the cathode surface to the material source, whereby the thickness of a layer deposited onto the surface varies as desired.

In operation of the photocathode 50, a light image is focused onto the photocathode from the substrate 52 side of the cathode, the light image passing through the transparent layers 54, 56, and 64 onto the photoemissive layer 68, and causing the photoemissive layer 68 to emit photoelectrons in accordance with the intensity pattern of the light image focused thereon. An advantage of the use of the transparent layers, in the various embodiments of the present invention, is that the presence of these layers does not significantly obstruct the passage of light to the photoemissive layer. This, in turn, permits the fabrication of photocathodes having high sensitivity.

By producing a suitable voltage distribution through the resistive layer 56, excellent image distortion correction is obtained. While the particular voltage distribution used depends upon the configuration of the imaging system in which the cathode is used, in general, a radial voltage distribution of the profile shown in FIG. 6 may be used with photocathodes 50 when used in imaging tubes of the type shown in FIG. 3. In FIG. 6, the ordinate is a normalized voltage, and the abscissa is normalized radial distance.

Another embodiment, not shown, is a "front-illuminated" photocathode of the type wherein, in operation, a light image is focused onto the photocathode from the photoemissive layer side of the cathode. Such a "front-illuminated" photocathode may be similar to the photocathode 50 shown in FIGS. 4 and 5 with the exception that the substrate 52 and the conductive layer 54 need not be transparent since radiations do not pass therethrough. The substrate 52 may be a metal, such as nickel, for example, and the conductive layer 54 is preferably a high reflective material such as aluminum. The reflective layer 54 serves to reflect back to the photoemissive surface 68 the fraction of the radiation which initially passed therethrough. This increases the quantum efficiency or sensitivity of the cathode.

What is claimed is:

1. A photocathode comprising a substrate having thereon, a photoemissive layer, an electrically resistive layer underlying the photoemissive layer, and terminal means electrically connected to spaced portions of said resistive layer, whereby a voltage differential may be applied between said spaced portions, the lateral resistivity of said resistive layer varying along the surface thereof.

2. A photocathode comprising a substrate, a conductive layer on said substrate, an insulating layer overlying said conductive layer, a resistive layer overlying said insulating layer, means for electrically connecting said conductive layer to said resistive layer, a photoemissive layer overlying said resistive layer, and means for making electrical contact with said conductive layer and said resistive layer, whereby a voltage differential may be applied across said resistive layer, said conductive, insulating and resistive layers being transparent.

3. A photocathode comprising a substrate having thereon, a photoemissive layer, an electrically resistive layer underlying the photoemissive layer, and terminal means electrically connected to spaced portions of said resistive layer, whereby a voltage differential may be applied between said spaced portions, the lateral resistivity of said resistive layer varying along the surface thereof, said resistive layer being transparent.

4. A photocathode comprising a substrate having thereon, a photoemissive layer, an electrically resistive layer underlying the photoemissive layer, and terminal means electrically connected to spaced portions of said resistive layer, whereby a voltage differential may be applied between said spaced portions, said spaced portions comprising a pair of concentric rings of conductive material.

5. A photocathode comprising a substrate having thereon, a photoemissive layer, an electrically resistive layer underlying the photoemissive layer, and terminal means electrically connected to spaced portions of said resistive layer, whereby a voltage differential may be applied between said spaced portions, said terminal means comprising wires extending through bores in said substrate.

6. A photocathode comprising a substrate having thereon, a photoemissive layer, an electrically resistive layer underlying the photoemissive layer, and terminal means electrically connected to spaced portions of said resistive layer, whereby a voltage differential may be applied between said spaced portions, said terminal means comprising wires extending through bores in said substrate, said resistive layer being transparent.

7. A photocathode comprising a substrate, a conductive layer on said substrate, an insulating layer overlying said conductive layer, a resistive layer overlying said insulating layer, means for electrically connecting said conductive layer to said resistive layer, a photoemissive layer overlying said resistive layer, and means for making electrical contact with said conductive layer and said resistive layer, whereby a voltage differential may be applied across said resistive layer, said insulating layer leaving uncovered spaced portions of said conductive layer, said resistive layer extending through said insulating layer into contact with one of said spaced portions of said conductive layer, and said electrical contacting means including a first terminal means connected to the other of said spaced portions of said conductive layer and a second terminal means connected to said resistive layer, said conductive, insulating, and resistive layers being transparent.

8. A photocathode comprising a substrate, a conductive layer on said substrate, an insulating layer overlying said conductive layer, a resistive layer overlying said insulating layer, means for electrically connecting said conductive layer to said resistive layer, a photoemissive layer overlying said resistive layer, and means for making electrical contact with said conductive layer and said resistive layer, whereby a voltage differential may be applied across said resistive layer, said insulating layer leaving uncovered spaced portions of said conductive layer, said resistive layer extending through said insulating layer into contact with one of said spaced portions of said conductive layer, and said electrical contacting means including a first terminal means connected to the other of said spaced portions of said conductive layer and a second terminal means connected to said resistive layer, said conductive, insulating, and resistive layers being transparent, the lateral resistivity of said resistive layer varying along the surface thereof.

9. A photocathode comprising a substrate, a conductive layer on said substrate, an insulating layer overlying said conductive layer, a resistive layer overlying said insulating layer, means for electrically connecting said conductive layer to said resistive layer, a photoemissive layer overlying said resistive layer, and means for making electrical contact with said conductive layer and said resistive layer, whereby a voltage differential may be applied across said resistive layer, said substrate being flat, said insulating layer leaving uncovered central and edge portions of said conductive layer, said resistive layer extending through said insulating layer into contact with said central portion, the lateral resistivity of said resistive layer varying radially symmetrically along the surface of said resistive layer, said conductive, insulating, and resistive layers being transparent, and said electrical connecting means including a first terminal means connected to an edge of said conductive layer and a second terminal means connected to an edge of said resistive layer.

10. A photocathode comprising a substrate, a conductive layer on said substrate, an insulating layer overlying said conductive layer, a resistive layer overlying said insulating layer, means for electrically connecting said conductive layer to said resistive layer, a photoemissive layer overlying said resistive layer, and means for making electrical contact with said conductive layer and said resistive layer, whereby a voltage differential may be applied across said resistive layer, said conductive layer being made of a highly reflective material, and said insulating and resistive layers being transparent.

* * * * *